US005299801A

United States Patent [19]

Sol et al.

[11] Patent Number: 5,299,801

[45] Date of Patent: Apr. 5, 1994

[54] TENNIS RACKET

[75] Inventors: Hugo Sol, Grimbergen; Isabelle Koeckelberg, Marcinelle; Jacques Meertens, Mominghies, all of Belgium

[73] Assignee: Donnay International S.A., Couvin, Belgium

[21] Appl. No.: 878,685

[22] Filed: May 5, 1992

[30] Foreign Application Priority Data

May 23, 1991 [DE] Fed. Rep. of Germany ..... 4116901
Nov. 11, 1991 [EP] European Pat. Off. ..... 91119160

[51] Int. Cl.[5] ..... A63B 49/02
[52] U.S. Cl. ..... 273/73 C
[58] Field of Search ..... 273/73 R, 73 C, 73 D, 273/73 F

[56] References Cited

U.S. PATENT DOCUMENTS

| | | | |
|---|---|---|---|
| 4,212,461 | 7/1980 | Cecka et al. | 273/73 F |
| 4,664,380 | 5/1987 | Kuebler | 273/73 C |
| 4,834,383 | 5/1989 | Woehrle et al. | 273/73 D X |
| 4,911,444 | 3/1990 | Yoneyama | 273/73 C |
| 5,037,098 | 8/1991 | Davis | 273/73 C |
| 5,076,583 | 12/1991 | Hsu | 273/73 C |

*Primary Examiner*—Vincent Millin
*Assistant Examiner*—Raleigh W. Chiu
*Attorney, Agent, or Firm*—Michael N. Meller

[57] ABSTRACT

The tennis racket has the particularity that the cross-sectional area of the frame in the plane of the stringing of the head portion comprises locally widened zones opposite to each other in the region of greatest width of the head portion, measured perpendicular to the longitudinal axis in the plane of the stringing, and optionally one locally widened zone at the free end of the head portion.

9 Claims, 3 Drawing Sheets

A-A&B-B

F-F
L
1
6
6'
7
2
3
A
A
30
31
4
F
F
F
F
B
B
A
A
15
L

A-A & B-B

C-C

D-D

E-E

F-F & G-G

2
A
A
30
31
G
G
G
G
B
B
C
C
D
D
E
E
F
F
32
15

TENNIS RACKET

The present invention relates to a tennis racket, and more particularly to a tennis racket of the kind having a longitudinal axis of symmetry, which comprises a handle extending substantially along the longitudinal axis, a head portion defined by a frame having an oval-shaped opening, stringing mounted on said frame and tensioned across said opening substantially along a plane, two connecting arms extending between the head and the handle, and a reinforcement member extending between the two connecting arms, as disclosed in co-pending U.S. patent application Ser. No. 618 294, filed on Nov. 27, 1990, commonly assigned to the Assignee of the present application, the contents of which are incorporated herein by reference.

This prior application is concerned with the realization of a light-weight, high strength racket having a rigid frame for the stringing and, to that effect, provides that in a main portion of the head, the cross-sectional height of the frame is essentially constant and that the cross-sectional width of the frame is comprised between 50% and 75% of the height.

The object of the present invention is to provide further means for increasing the strength of the frame to thereby improve the playing properties of the racket.

In accordance with a first aspect of the present invention, this object is met in a tennis racket of the kind set forth at the beginning by the fact that the cross-section of the frame comprises locally widened zones opposite to each other in the region of greatest head width of the head portion, measured perpendicular to the longitudinal axis in the plane of the stringing.

According to an other aspect of the invention, this object is met by the fact that the cross-section of the frame comprises a locally widened zone at the free end of the head portion and two locally widened zones opposite to each other in the region of greatest head width of the head portion, measured perpendicular to the longitudinal axis in the plane of the stringing.

Owing to the local widenings of the cross-section of the frame in the head part, provided in accordance with the invention, an ideal and constant distribution of the stresses of the head part caused by the tensioning of the racket head, whereby improvements of the hitting properties are in turn achieved.

Advantageous developments of the invention are described in the following description.

Figures 1, 2, 3:
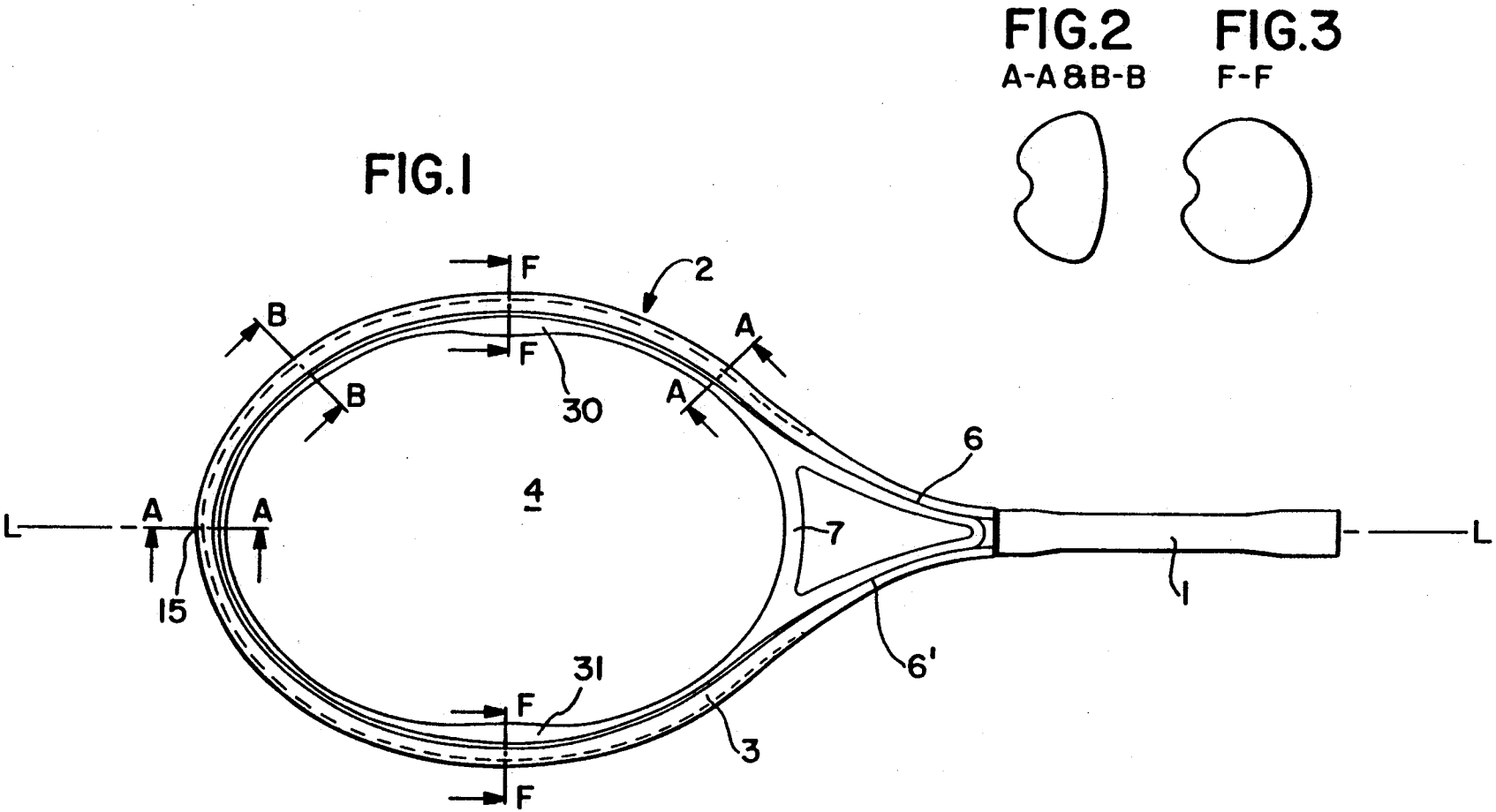
Figure 4:
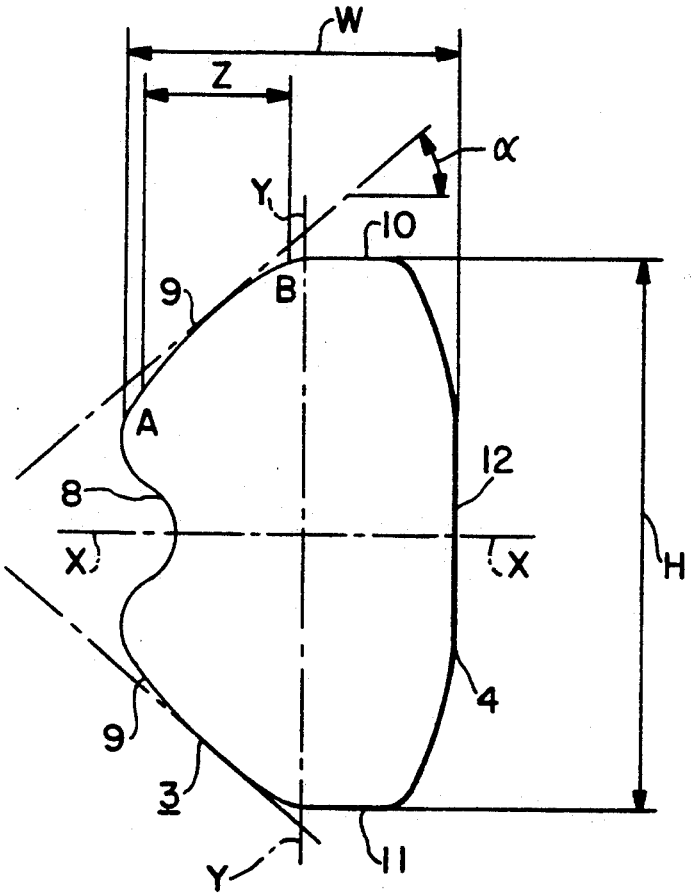
Figures 5, 6, 7, 8, 9, 10:
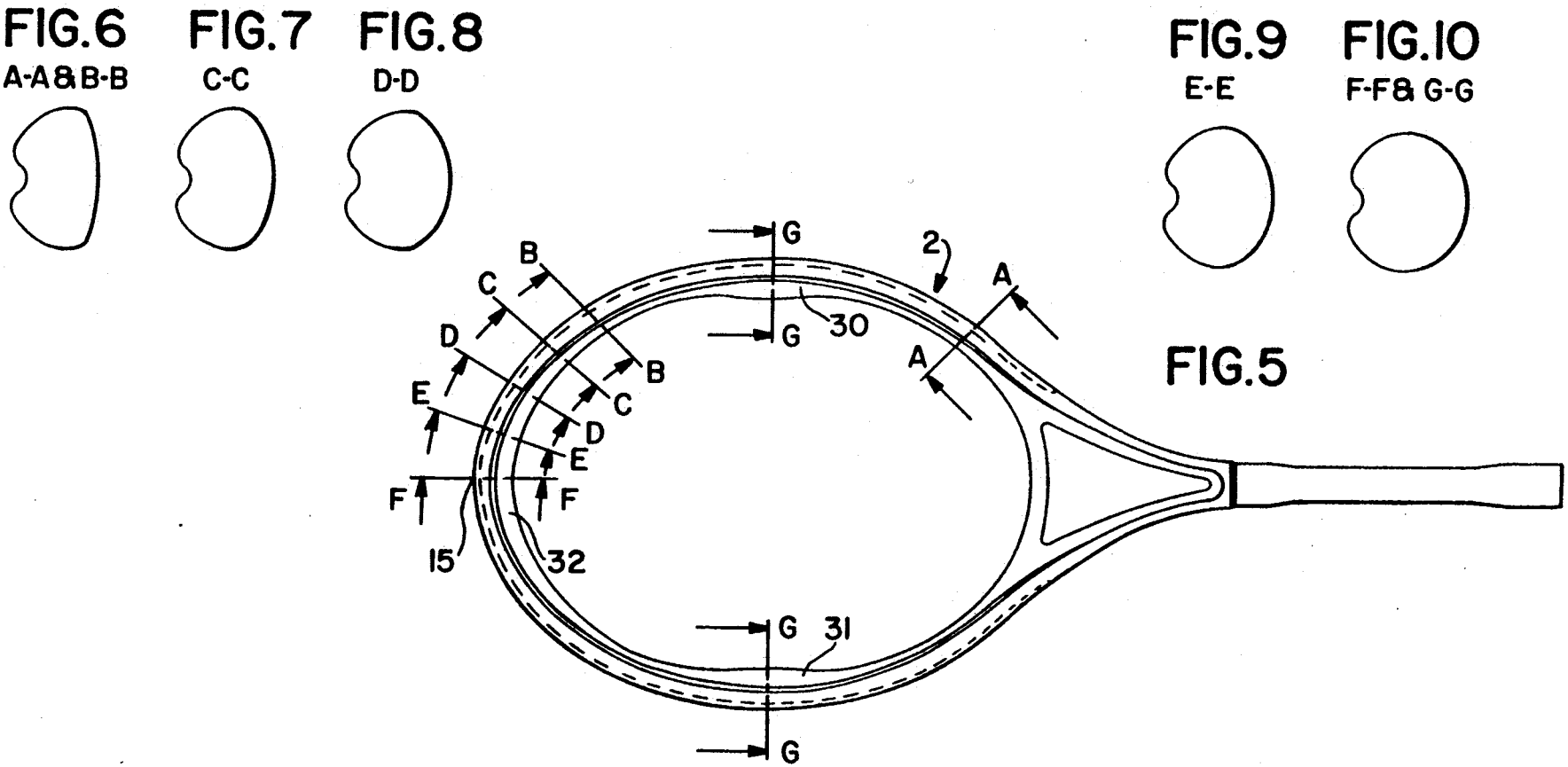

The invention will be thereafter explained in more detail with reference to the drawings; the latter show:

FIG. 1 a plane view of a first preferred embodiment of a racket of the invention, FIG. 2 a cross-sectional view taken along lines AA and BB in FIG. 1, FIG. 3 a cross-sectional view taken along line FF in FIG. 1, FIG. 4 a detailed typical cross-sectional view of the frame of the racket of FIG. 1, FIG. 5 a plane view of a second preferred embodiment of a racket of the invention, and FIGS. 6, 7, 8, 9 and 10 are true-scale cross-sectional views taken along the cutting lines AA and BB; CC; DD; EE; FF and GG in FIG. 5 respectively.

The tennis racket illustrated in plane view in FIG. 1 comprises in a usual manner three regions arranged successively along a longitudinal axis of symmetry LL:

a handle part 1, a head part 2 which is formed by a frame 3 which surrounds an opening 4 and has a generally oval plane shape, two connecting arms 6, 6' which are integrally made with the frame 3 as extensions thereof and extend into the handle part 1.

The racket further comprises a yoke part or reinforcing member 7, which connects integrally the connecting arms 6, 6' and delimits the opening 4 towards the handle part 1.

A stringing, not shown in order to simplify the figure, is tensioned over the opening 4 and lies generally in a plane, with the individual strings which constitute the stringing extending in directions parallel and perpendicular to the longitudinal axis of symmetry LL and are guided in a usual manner through passages or bores, not shown, provided in the frame of the head part 2 or in the reinforcing member 7. The frame 3 comprises a profile section having the typical cross-section shown in FIG. 4. This profile section is for example formed as a tube-shaped, thin-walled, closed profile, the inner cavity of which can be filled with a material which has practically no influence on the mechanical properties of the profile.

Referring to the axes shown in FIG. 4, the axis XX extends in the plane and the axis YY extends perpendicular to the plane of the stringing. The outer edges of the cross-section can be inscribed in an isosceles triangle the basis of which lies on the stringing side. The profile comprises a reentrant concave portion or groove 8 on the XX axis and on the outer side remote from the opening 4, for accommodating the strings between two passages which lead to the opening 4 of the frame 3 (not shown).

The cross-section of the frame increases at least in the upper half of the head remote from the handle towards the free end of the handle. The circumference of this cross-section is greater than or equal to 85 mm, and at the free end of the head, the cross-section has approximately a circular form and a circumference of about 90 mm.

In order to resist without excessive inwardly directed deformations to the loads exerted by the stringing on the frame both under static and under dynamic conditions, the profile comprises substantially flat wall portions 9 which connect the groove 8 to the upper and lower summit areas 10, 11, arranged on the YY axis and substantially planar, parallel to the plane of the stringing. The wall portions 9 are inclined relative to the plane of the stringing at an angle $\alpha$ comprised between 25° and 65°, and preferably 45°.

More precisely, the wall portions 9 extend between points A and B where the angle between a tangent to the profile and the plane of the stringing has the values 65° and 25° respectively. The width of the wall portions 9, measured between these points A and B in the plane of the stringing is denoted by Z, whereas the width of the profile, also measured in the same plane, is denoted by W. Preferably, within the scope of the present invention, the ratio between the width Z of the wall portions and the width W of the profile is comprised between 30 and 70%, and more preferably between 40 and 60%.

The inner side 12 of the profile can be substantially straight at least in its middle region and is preferably slightly curved in the direction of the opening 4.

The shapes and proportions of the above described typical cross-section vary in the handle part 1, in the connecting arms 6, 6' and in the various portions of the head part 2, as explained in the above-mentioned copending U.S. patent application Ser. No. 618 294, to which reference is made in this respect in order to avoid unnecessary repetitions.

Owing to the special design of the cross-sections, the wall portions 9 achieve an arch structure together with the inner side 12 of the profile, whereby one obtains a racket having a high stability, which simultaneously has a relatively low weight. The characteristic cross-sections achieve a high stiffness against flexions within and out of the plane of the racket, and the special geometry of the cross-sections for the head part allows a significant reduction of the wall thickness of the cross-section, which leads to the above mentioned weight reduction. It is important that the torsion moment of inertia can also be increased for a lower mass by means of these cross-sections.

The profile can be advantageously realized as described in the already mentioned copending U.S. patent application Ser. No. 618 294, i.e. the profile is made out of a composite material and two plies of this composite material are overlapped in the region of the outer groove to achieve a reinforcement in this region. The various dimensions disclosed in this copending application can also be advantageously used in the present invention.

In the first preferred embodiment of FIG. I the cross-sectional width W of the frame has widenings 30, 31 formed in the regions of the greatest width of the head part 2 and widen inwardly only in these regions of the frame in plane view. The maximum value of the cross-sectional width at section planes F—F continuously decreases in the direction of the cutting plane B—B, i.e. over a region having a length between 4/9 and 5/9, preferably 4,5/9 (½) of the distance between the cutting planes FF and AA, measured from FF towards the free end 15 on the curved line in the plane of the stringing along the outer circumference of the head portion (FIG. 1). Thereafter the cross-sectional width W remains constant in the direction of the free end 15.

Preferably, the height H of the cross-section of the frame, measured perpendicular to the plane of the stringing, remains substantially constant from the connecting arms 6 to at least beyond the region of greatest width of the head portion, for example up to about the last third of the head portion, measured along the longitudinal axis LL.

In FIGS. 2 and 3 the cross-sectional views A—A, B—B and F—F are drawn up at a true scale in respect of the dimension relationships.

In the second preferred embodiment of FIG. 5, local widenings 30, 31 of the width of the cross-section of the frame are provided in the region of the greatest width of the head part 2, and such a widening 32 of the cross-sectional width is also realized at the upper end 15 of the frame.

The corresponding cross-sections AA & BB, CC, DD, EE, FF & GG shown in FIGS. 6, 7, 8, 9 and 10 are also drawn up at a true scale.

The important point is that the local maximum value of the cross-sectional width W in section G—G decreases in the direction of the section B—B down to a minimum value which corresponds to the width at the section plane A—A, and increases again continuously, until reaching the maximum value of the cross-sectional width W at the upper end 15 at section F—F, with the width passing by the intermediate values of sections C—C, D—D, and E—E.

The cross-sectional width decreases from the locally widened zone 32 at the free end 15 of the head portion over a zone having a length of about half the length between the position of the greatest head width of the frame and the free end of the head, measured on the curved line in the plane of the stringing along the outer circumference of the head portion, and increases thereafter towards the locally widened zones 30, 31 in the region of greatest width of the head portion.

Preferably, the height H of the cross-section of the frame, measured perpendicular to the plane of the stringing, remains substantially constant from the connecting arms to at least beyond the region of greatest width of the head portion, for example up to about the last third of the head portion, measured along the longitudinal axis.

Advantageously, in the two above-mentioned embodiments of the present invention, the circumference of the cross-section of the frame has the same characteristics as in U.S. patent application Ser. No. 618 294 already mentioned.

We claim:

1. A tennis racket having a longitudinal axis of symmetry, which comprises a handle extending substantially along the longitudinal axis, a head potion having a free end through which the longitudinal axis extends and being defined by a frame having an oval-shaped opening, stringing mounted on said frame and tensioned across said opening substantially along a plane, two connecting arms extending between the head portion and the handle, and a reinforcement member extending between two connecting arms, wherein a), the cross-section of the frame comprises locally widened zones opposite to each other in the region of greatest width of the head portion, measured perpendicular to the longitudinal axis and in the plane of the stringing;

b), the width of the cross-section of the frame, measured in the plane of the stringing, decreases from the the region of greatest width of the head portion to about one-half the way to the free end of the head portion and, thereafter, the cross-section of the frame, measured in the plane of the stringing remains constant up to the free end of the head portion; and c), the height of the cross-section of the frame, measured perpendicular to the plane of the stringing, remains substantially constant from the connecting arms to a region beyond the region of greatest width of the head portion.

2. A tennis racket according to claim 1, wherein said height remains constant up to about the last third of the head portion, measured along the longitudinal axis.

3. A tennis racket according to claim 1, wherein the frame of the head portion is made out of tubular thin-wall closed profile having a reentrant concave portion at the outer side thereof opposite from the opening, two wall portions and upper and lower summit areas, the two wall portions joining the concave portion to upper and lower summit areas of the profile, said wall portions being inclined with respect to the plane of the stringing at an angle $\alpha$ of about 25° to 65°, and wherein the ratio between the width Z of said wall portions, measured in the plane of the stringing, and the width W of the profile, measured in the same plane, is about 40% to 60%.

4. A tennis racket according to claim 3, wherein said angle $\alpha$ is about 45°.

5. A tennis racket having a longitudinal axis of symmetry, which comprises a handle extending substantially along the longitudinal axis, a head potion having a free end through which the longitudinal axis extends defined by a frame having an oval-shaped opening, stringing mounted on said frame and tensioned across said opening substantially along a plane, two connecting arms extending between the head portion and the handle, and a reinforcement member extending between two connecting arms, wherein a), the cross-section of the frame comprises a locally widened zone at the free end of the head portion and two locally widened zones opposite to each other in the region of greatest width of the head portion, measured perpendicular to the longitudinal axis and in the plane of the stringing;

b), the width of the cross-section of the frame, measured in the plane of the stringing, decreases from the locally widened zone at the free end of the head portion to about one-half the way to the region of greatest width of the head portion, and increases thereafter towards the locally widened zones in the region of greatest width of the head portion; and c), the height cross-section of the frame, measured perpendicular to the plane of the stringing, remains substantially constant from the connecting arms to a region beyond the region of greatest width of the head portion.

6. A tennis racket according to claim 5, wherein said height remains constant until about the last third of the head portion, measured along the longitudinal axis.

7. A tennis racket according to claim 5 wherein the circumference of the cross-section of the frame increases at least in the upper half of the head portion remote from the handle towards the free end of the handle.

8. A tennis racket according to claim 7, wherein said circumference is greater than or equal to 85 mm, and wherein, at the free end of the head portion, the cross-section has approximately a circular form and a circumference of about 90 mm.

9. A tennis racket having a longitudinal axis of symmetry, said tennis racket comprising a handle extending substantially along the longitudinal axis, a head defined by a frame having an oval-shaped opening, stringing mounted on said frame and tensioned across said opening substantially along a plane, connecting arms extending between the head and the handle, and a reinforcement member extending between the connecting arms, the cross-section of the frame including locally widened zones opposite to each other in the region of greatest width of the head, measured perpendicular to the longitudinal axis and in the plane of the stringing, the frame being formed of a tubular, thin-walled, closed profile, said profile having a reentrant concave portion at the outer side of the frame opposite from the opening, upper and lower summit areas, and first and second substantially flat wall portions joining the concave portion to the respective upper and lower summit areas, said first and second substantially flat wall portions being inclined with respect to the plane of the stringing at an angle of between about 25° and 65°, the ratio between the width Z of said wall portions, measured along a plane parallel to the panel of the stringing between two points where a tangent to the profile is between about 25° and 65° to the plane of the stringing, and the width W of the profile, measured in the same plane of the stringing, is between about 30 and 70%.

* * * * *